US008533901B2

(12) United States Patent
Williams

(10) Patent No.: US 8,533,901 B2
(45) Date of Patent: Sep. 17, 2013

(54) SELF-CONTAINED CLEANING DEVICE FOR SHOE SOLES

(76) Inventor: Bennie E. Williams, Knoxville, TN (US)

( * ) Notice: Subject to any disclaimer, the term of this patent is extended or adjusted under 35 U.S.C. 154(b) by 293 days.

(21) Appl. No.: 12/983,712

(22) Filed: Jan. 3, 2011

(65) Prior Publication Data

US 2012/0167338 A1 Jul. 5, 2012

(51) Int. Cl.
*A47L 23/26* (2006.01)
*A47L 23/22* (2006.01)

(52) U.S. Cl.
USPC ..... 15/311; 15/308; 15/303; 15/37

(58) Field of Classification Search
USPC ..... 15/301, 302, 303, 308, 311, 36, 37, 15/380
IPC ..... A47L 23/06, 23/22, 23/24, 23/26
See application file for complete search history.

(56) References Cited

U.S. PATENT DOCUMENTS

| | | | | | |
|---|---|---|---|---|---|
| 1,359,193 | A * | 11/1920 | Parker | 15/311 |
| 1,972,682 | A * | 9/1934 | Fitz Gerald | 60/377 |
| 2,577,294 | A * | 12/1951 | Aben | 15/37 |
| 2,647,271 | A * | 8/1953 | Ryzenga | 15/37 |
| 2,649,599 | A * | 8/1953 | Leadingham | 15/37 |
| 2,895,159 | A * | 7/1959 | Ostrow | 15/311 |
| 3,029,452 | A * | 4/1962 | Scott | 15/37 |
| 3,037,225 | A * | 6/1962 | Ellis | 15/37 |
| 3,115,653 | A * | 12/1963 | Fresh et al. | 15/37 |
| 3,165,773 | A * | 1/1965 | Palpacelli | 15/310 |
| 3,233,266 | A * | 2/1966 | Darby | 15/37 |
| 3,649,994 | A * | 3/1972 | Harris | 15/311 |
| 3,786,531 | A * | 1/1974 | Borg | 15/310 |
| 4,313,238 | A * | 2/1982 | Harbin | 15/37 |
| 4,922,578 | A * | 5/1990 | Miettinen | 15/36 |
| 5,345,651 | A * | 9/1994 | Roberts | 15/397 |
| 5,964,959 | A * | 10/1999 | Bleth | 134/32 |
| 5,991,967 | A * | 11/1999 | Williams | 15/311 |
| 6,532,618 | B2 * | 3/2003 | Koch | 15/310 |
| 6,668,842 | B1 * | 12/2003 | Wilke et al. | 134/44 |
| 7,472,452 | B2 * | 1/2009 | Junell | 15/310 |
| 7,500,488 | B1 * | 3/2009 | Long | 134/136 |
| 8,161,590 | B2 * | 4/2012 | Feeg et al. | 15/34 |
| 2007/0271715 | A1 * | 11/2007 | Scoralle | 15/104.92 |
| 2008/0104782 | A1 * | 5/2008 | Hughes | 15/30 |
| 2010/0011962 | A1 * | 1/2010 | Totsugi | 96/400 |

* cited by examiner

*Primary Examiner* — Lee D Wilson
*Assistant Examiner* — Tyrone V Hall, Jr.
(74) *Attorney, Agent, or Firm* — Pitts & Lake, P.C.

(57) ABSTRACT

A cleaning device for shoe soles is disclosed. The cleaning device provides a surface having a plurality of bristles designed to engage the sole of a shoe. The bristles are arranged such that one or more groups of bristles are reciprocated over the length of the surface to dislodge and remove debris on the shoe sole. The debris removed from the shoe sole is also directed away from the bristles and surface into a receptacle for later removal. Thus, the cleaning device provides for effortless removal of debris from shoe soles while cleaning any debris dislodged by the bristles.

5 Claims, 6 Drawing Sheets

SELF-CONTAINED CLEANING DEVICE FOR SHOE SOLES

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

The invention pertains to the field of cleaning devices for removing debris from shoe soles.

2. Description of the Related Art

Conventional shoe cleaning devices are typically provided at the entrance into a clean environment. For example, residences often have a doormat located at the front entrance, which allows a person to clean the bottom of their footwear before entering. These conventional doormats consist of a mat having multiple bristles that project upwards from the top surface of the mat. A person desiring to clean their shoe soles stands on the doormat and drags the sole of the shoe across the bristles such that the bristles come into contact with any debris that is located within the shoe's tread. Thus, allowing a person to remove some of the debris from their shoe soles.

Unfortunately, repeated use of the doormat typically results in dirt and debris buildup on the bristles, thereby making the doormat ineffective for cleaning footwear. Although some shoe cleaning devices have been designed with openings defined within the mat such that removed debris can fall into these openings and delay the buildup on the bristles, the openings fill up and still require frequent cleaning.

BRIEF SUMMARY OF THE INVENTION

A cleaning device for shoe soles is described herein and shown in the accompanying figures. The cleaning device includes a housing and a platform. The platform of the cleaning device includes a plurality of bristles projecting from the top surface of the platform designed to engage the sole of the shoe when placed on the platform. The bristles are arranged such that one or more groups of bristles are reciprocated over the length of the surface to dislodge and remove debris on the shoe sole.

The housing of the cleaning device encloses a drive assembly and a debris removal assembly. The drive assembly is in mechanical communication with a group of bristles such that the drive assembly reciprocates the respective bristles. The debris removed from the shoe sole is also directed away from the shoe soles and bristles by the debris removal assembly. For example, the debris removal assembly is configured for directing the debris loosened and/or dislodged from the shoe sole away from the shoe sole, bristles, and platform and into a debris collector. Thus, the cleaning device provides for effortless cleaning of debris from shoe soles while removing any debris dislodged by the bristles.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A cleaning device for shoe soles is described in detail herein and shown in the accompanying figures. The cleaning device provides a surface having a plurality of bristles designed to engage the sole of a shoe. The bristles are arranged such that one or more groups of bristles are reciprocated over the length of the surface to dislodge and remove debris on the shoe sole. The debris removed from the shoe sole is also directed away from the bristles and surface into a receptacle for later removal. Thus, the cleaning device provides for effortless removal of debris from shoe soles while cleaning any debris dislodged by the bristles.

Figure 1:
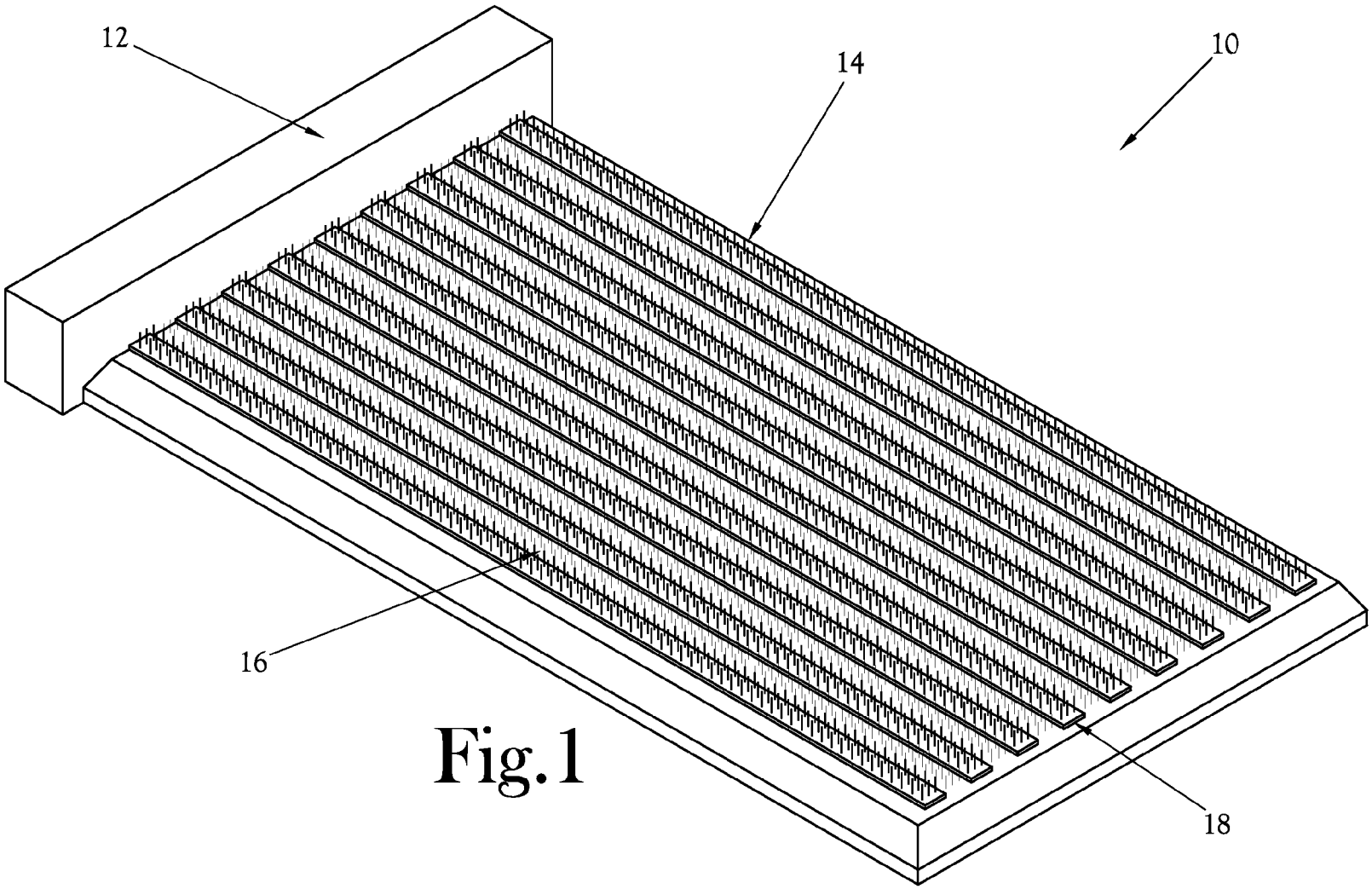
FIG. 1 illustrates a perspective view of an example embodiment of the invention.

FIG. 1 illustrates a perspective view of an example embodiment of a cleaning device 10 for shoe soles. The cleaning device 10 includes a housing 12 and a platform 14. In the illustrated embodiment, the housing 12 is positioned at one end of the platform 14 such that the cleaning device 10 is designed for placement on a substantially flat surface, for example the ground near an entrance of a building. Generally, the platform 14 is designed to be easily accessible for cleaning shoe soles. For example, in the illustrated embodiment, the platform 14 for the cleaning device 10 has a low profile relative to the ground. Specifically, the height of the top surface of the platform 14 is designed for allowing a person to easily place one shoe or two shoes on the platform 14 for cleaning.

The platform 14 of the cleaning device 10 for shoe soles includes a plurality of bristles 16 projecting from the top surface of the platform 14 to engage the sole of the shoe when placed on the platform 14. The bristles 16 are arranged along the surface of the platform 14 such that a group of bristles 16 define a plurality of longitudinal brushes 18. The brushes 18 are arranged to define a plurality of rows of brushes 18 spaced apart from each other along the surface, such that the rows of brushes 18 are configured to be moved in a reciprocating fashion along the length of the top surface.

The reciprocation of the brushes 18 provides improved cleaning and stability of the shoe soles. Specifically, the reciprocating brushes 18 improve cleaning by increasing the frequency of contact between the bristles 16 and debris and increasing the friction of the bristles 16 against the shoe sole. In contrast, although rotating brushes may provide a cleaning function, the rotation of the brushes typically encourages shoe laces to become tangled and wrapped around in the brushes, damaging the equipment and shoes, and leading to possible injury of the person. Furthermore, rotating brushes are often designed on a cylinder which contributes to an uneven cleaning surface, which can contribute to stability problems for a person. Alternatively, although oscillating brushes may avoid some of the problems associated with rotating brushes, the oscillation of the brush can cause ultrasonic vibrations leading to possible discomfort to the individual, including headaches.

Furthermore, the reciprocation of the bristles 16 allows a user to effortlessly clean hard to remove debris from their shoe soles by shifting a larger portion of the person's weight to a particular shoe, i.e., increasing the downward force on the bristles 16, thereby increasing the force and friction exerted by the bristles 16 on the debris located on the shoe sole.

The housing 12 of the cleaning device 10 encloses a drive assembly and a debris removal assembly. As described in more detail with respect to FIG. 6, the drive assembly is in mechanical communication with a group of bristles 16 such that the drive assembly reciprocates the respective bristles 16. The reciprocation of the bristles 16 engages the sole(s) of a shoe or shoes such that debris is removed from the shoe sole. The debris removal assembly is arranged such that debris loosened and/or dislodged from the shoe sole is directed away from the shoe sole, bristles 16, and platform 14.

Figure 2:
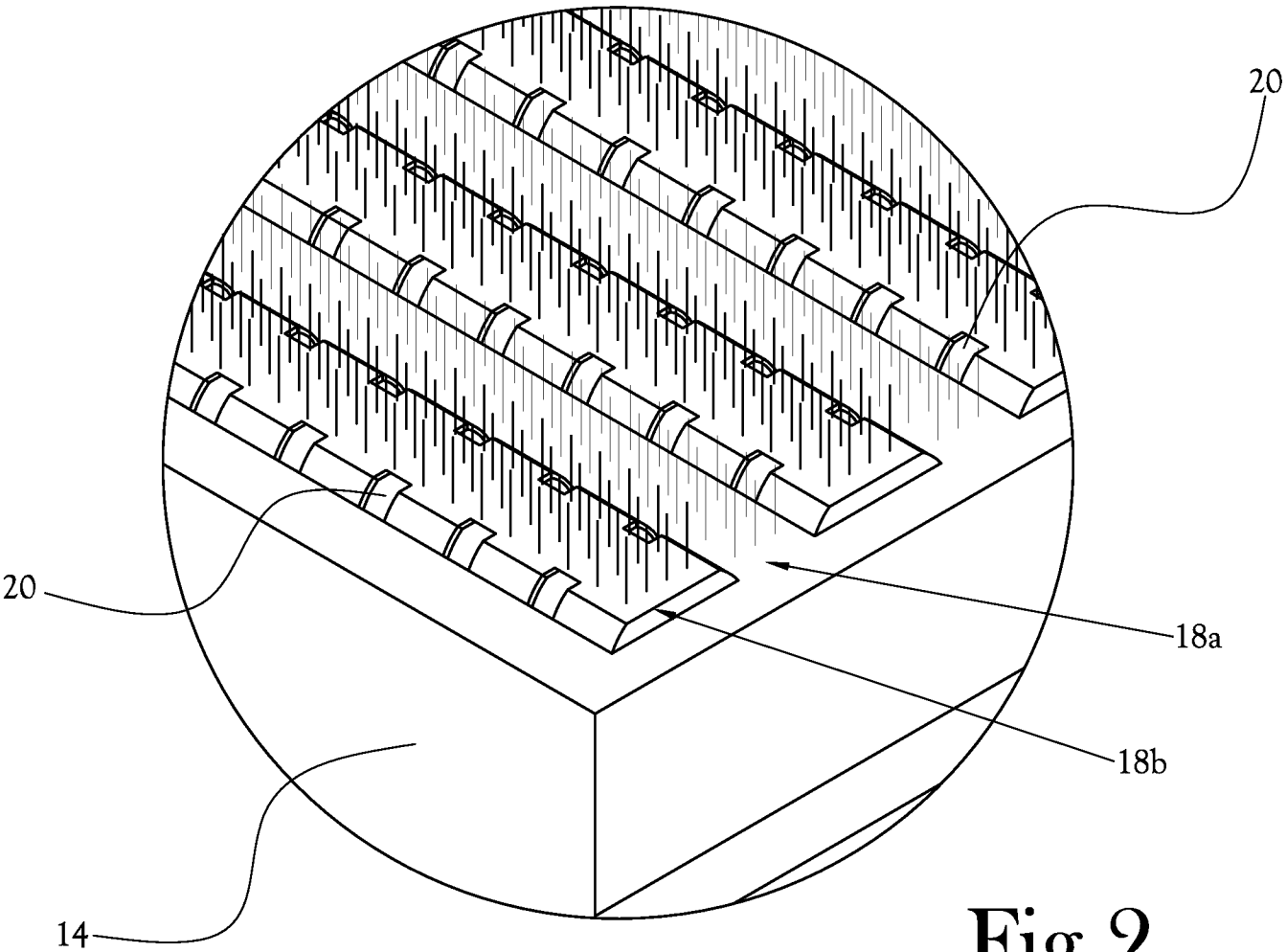
FIG. 2 illustrates an enlargement of the embodiment of the invention depicted in FIG. 1.

FIG. 2 illustrates, in greater detail, an enlargement of the cleaning device 10 for shoe soles as depicted in FIG. 1. As discussed above, the cleaning device 10 for shoe soles includes a plurality of spaced apart rows of brushes 18 configured to be reciprocated. In one embodiment of the cleaning device 10, the rows of brushes 18 can be reciprocated in alternating directions, although the present general inventive concept is not limited thereto. In the illustrated embodiment, the cleaning device 10 includes two types of brushes 18, namely a plurality of stationary brushes 18*a* and a plurality of reciprocating brushes 18*b*. As depicted in FIG. 2, the stationary brushes 18*a* and the reciprocating brushes 18*b* are arranged in an alternating pattern on the top surface of the cleaning device 10.

The stationary brushes 18*a* are configured to provide additional cleaning between the reciprocating brushes 18*b* and serve to substantially support the person such that the person's weight does not affect or inhibit the movement of the reciprocating brushes 18*a*. For example, in one embodiment, the height of the stationary brushes 18*a* approximately define the resting position for the shoe sole and inhibits the shoe from moving while the reciprocating brushes 18*b* move with respect to the shoe sole. Other considerations for selecting the stationary brushes 18*a* include, but are not limited to, the rigidity of the bristles 16 and the resiliency of the bristles 16. By providing stationary brushes 18*a* between the rows of reciprocating brushes 18*b*, it is possible to increase the stability of the person during the cleaning process.

Referring to FIG. 2, the reciprocating brushes 18*b* are configured to engage the sole of a shoe to dislodge any debris on the soles. In the illustrated embodiment, the bristles 16 forming the reciprocating brushes 18*b* are longer than the stationary brushes 18*a* such that the bristles 16 project into the tread of the shoe for dislodging the debris located therein. Other considerations for selecting the reciprocating brushes 18*b* include, but are not limited to, the rigidity of the bristles 16, the resiliency of the bristles 16, and their overall resistance to static electricity.

Figure 4:
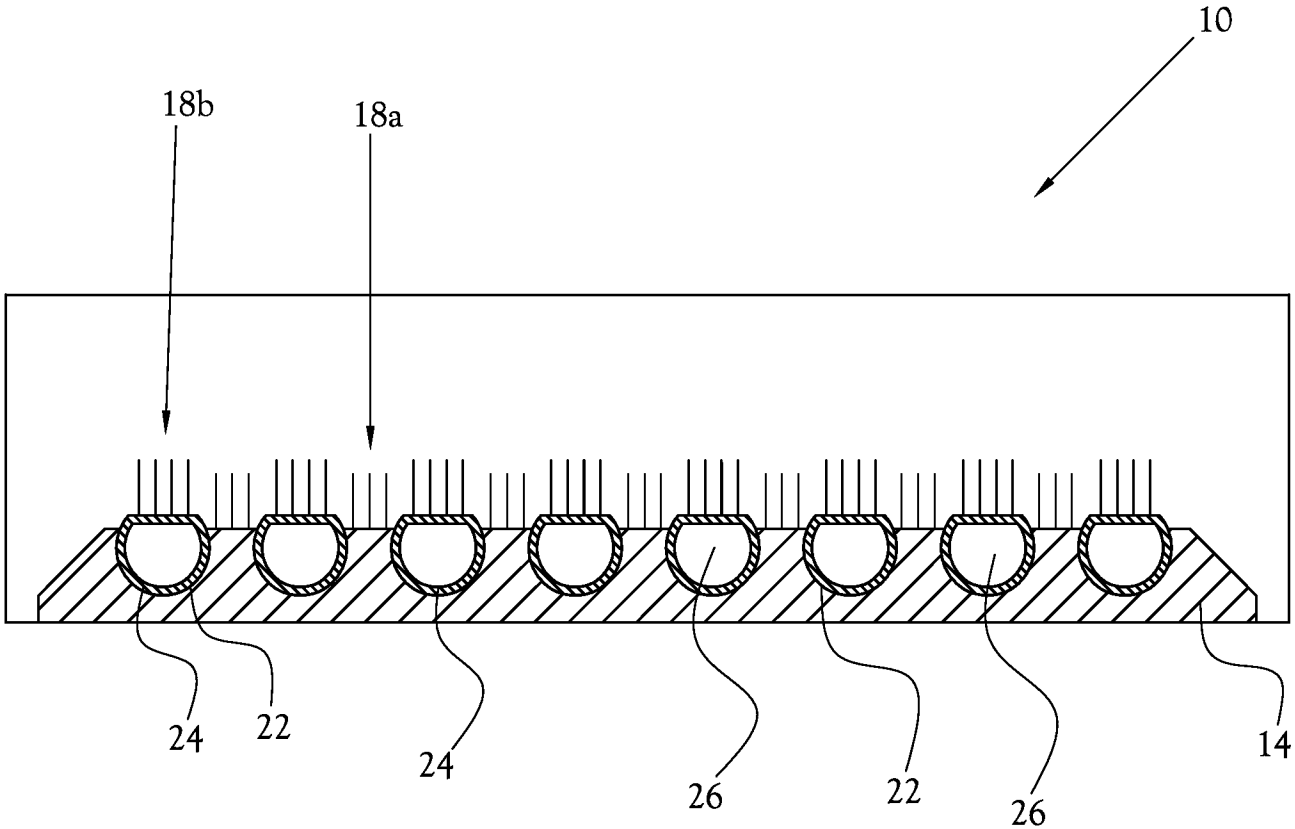
FIG. 4 illustrates a sectional view along 4-4 of the embodiment of the invention depicted in FIG. 3.

As illustrated in FIG. 2, the reciprocating brushes 18*b* include a plurality of vents 20 positioned at various increments along the base of the bristles 16. The vents 20 provide passageways for dirt and debris to be directed away from the platform 14 and bristles 16 and into the duct 26 (FIG. 4). In the illustrated embodiment, the vents 20 are arranged such that small and large debris can be removed. The vents 20 also allow for suctioning of any loosed debris residing on the shoe sole, as described in more detail below with respect to FIG. 6.

Figure 3:
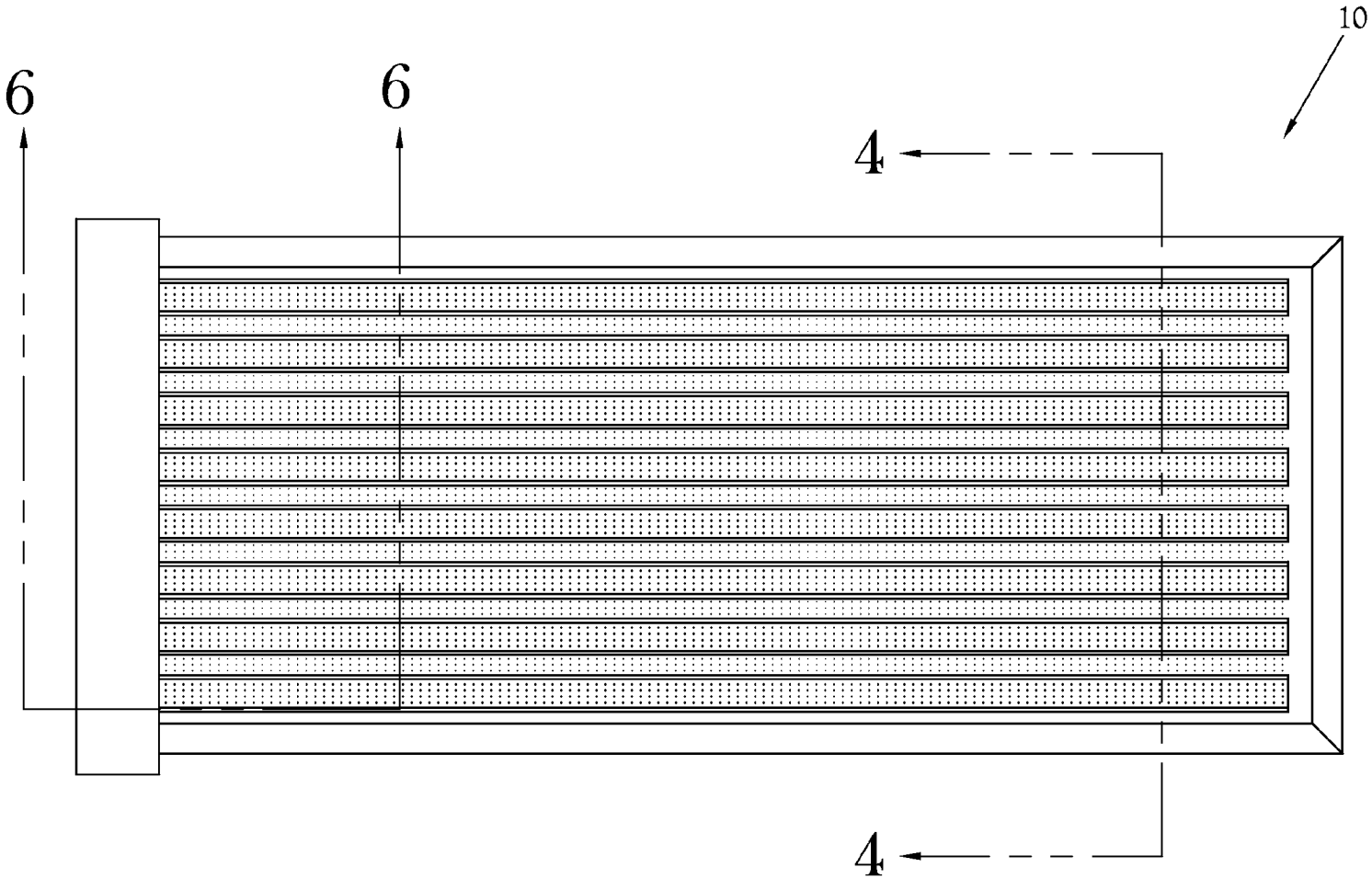
FIG. 3 illustrates a top view of the embodiment of the invention depicted in FIG. 1.

FIG. 3 illustrates top plan view of one embodiment of a cleaning device 10.

FIG. 4 illustrates a section view along 4-4 of the cleaning device 10 for shoe soles depicted in FIG. 3. Specifically, the embodiment illustrated in FIG. 4 depicts the platform 14, the reciprocating brushes 18*b*, and the stationary brushes 18*a*. The platform 14 is generally solid and is configured to support the weight of the person using the cleaning device 10. The platform 14 also includes a plurality of channels 22 defined along the length of the platform 14. Each of the channels 22 is configured for receiving a brush tube 24 for one of the reciprocating brushes 18*b*. The brush tube 24 is received within the channel 22 such that the brush tube 24 is linearly moveable along the length of the channel 22. Each brush tube 24 is generally hollow and includes a central cavity that defines a duct 26 utilized by the debris removal assembly.

As illustrated in FIG. 4, the cross-section of the brush tube 24 is substantially circular and includes a flat top segment where the bristles 16 are attached. The plurality of vents 20 are positioned at spaced locations near the upper edges of the brush tube 24. In this arrangement, any loose debris on the top surface of the platform 14 is directed downward into the ducts. The bottom portion of the brush tube 24 is arranged such that debris build-up or obstructions in the duct are minimized. For example, in the illustrated embodiment the curvature of the bottom portion of the brush tube 24 is configured to minimize any impediment to debris directed by the debris removal assembly. In addition to the cross-section shape of the brush tube 24, the brush tube 24 is also substantially linear to prevent any low points or edges that can generate obstructions.

In another embodiment, the brush tube 24 is connected to a shaker mechanism which uses ultrasonic vibrations to facilitate the movement of debris within the brush tube 24. The use of ultrasonic vibrations is particularly advantageous in wet applications, where debris has a tendency to gum up or create obstructions. In such applications, the ultrasonic vibrations are realized within the housing and platform of the cleaning device 10 to prevent contact with the person using the cleaning device 10, which could cause headaches.

Figure 5:
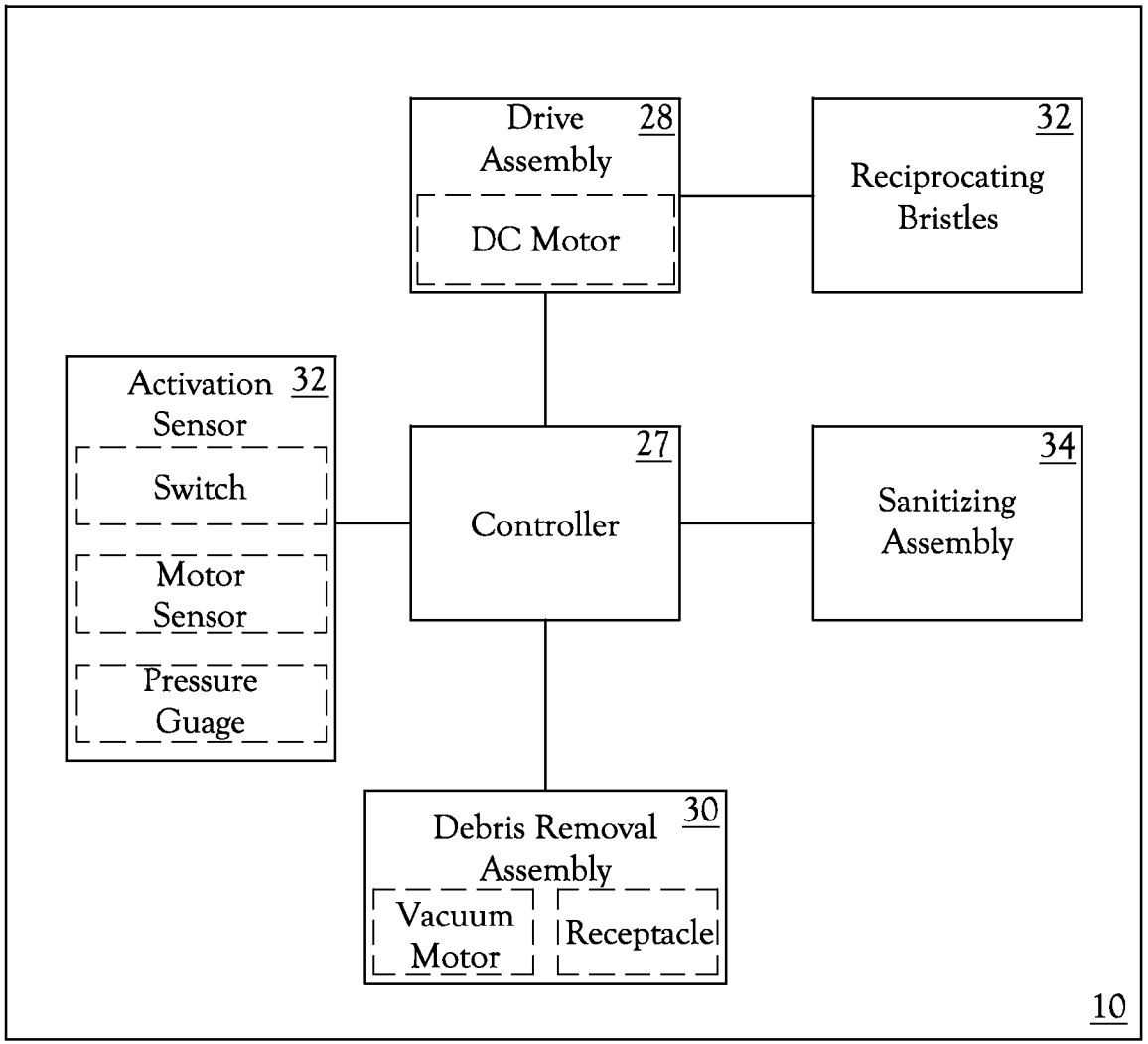
FIG. 5 illustrates a block diagram of an electrical schematic according to an example embodiment of the invention.

FIG. 5 illustrates a block diagram of one embodiment of a cleaning device 10 for shoe soles. Specifically, FIG. 5 provides a representation of the components in one embodiment of the cleaning device 10. The cleaning device 10 includes a controller 27, or other type of logic unit, that manages the drive assembly 28 and the debris removal assembly 30 and determines when to begin the cleaning process.

The controller 27 determines when to begin the cleaning process by receipt of input from a sensor or alternatively the user. In the illustrated embodiment, the cleaning device 10 includes an activation sensor 32. In one embodiment of the cleaning device 10, the activation sensor 32 is a motion sensor that detects when a person's shoe is positioned on the top surface of the cleaning device 10. In alternate embodiments, the activation sensor 32 includes an activation switch, a pressure gauge on the platform 14, or other type of sensor for input to the controller 27.

The controller 27 is in electrical communication with the drive assembly 28 such that when the controller 27 manages the operation of the drive assembly 28. Upon receipt of input from the activation sensor 32, the controller 27 activates the drive assembly 28. The drive assembly 28 generally includes a motor, such as a DC motor. The drive assembly 28 is in mechanical communication with reciprocating bristles 32 such that activation of the drive assembly 28 reciprocates the reciprocating bristles 32.

When cleaning the shoe soles, the controller 27 also manages the operation of the debris removal assembly 30. The operation of the debris removal assembly 30 includes suctioning of air through the brush tube 24 ducts such that debris removed from the shoe soles is directed away from the bristles 16 and platform 14 into a receptacle. For example, in one embodiment, the debris removal assembly 30 includes a vacuum motor that suctions debris into a debris receptacle to receive the debris until being emptied later.

Furthermore, in one embodiment, the controller 27 is further in communication with a sanitizing assembly 34. The sanitizing assembly 34 is provided for afterwards sanitization of the shoe soles. For example, in one embodiment the sanitizing assembly 34 includes a sprayer in fluidic communication with a sanitizer for spraying the soles of the shoes after the reciprocating brushes 18*b* remove debris from the shoe soles.

Figure 6:
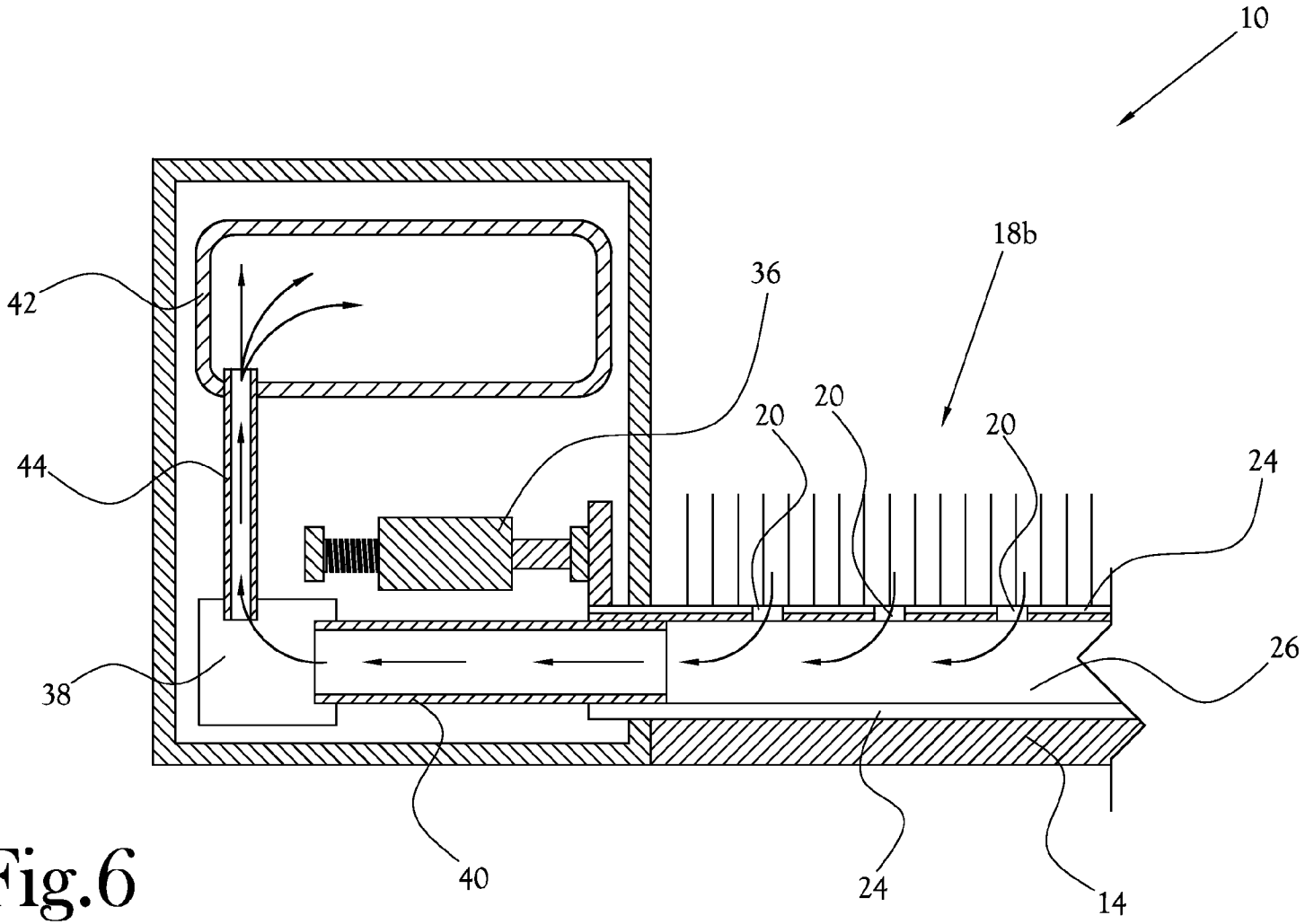
FIG. 6 illustrates a sectional view along 6-6 of the embodiment of the invention depicted in FIG. 3.

FIG. 6 illustrates a section view along 6-6 of the cleaning device 10 for shoe soles depicted in FIG. 3. More specifically, the cleaning device 10 depicted in FIG. 6 illustrates the interior of the housing 12 in relation to the platform 14. In the illustrated embodiment, the components enclosed within the housing 12 include a drive assembly 28 and a debris removal assembly 30.

The drive assembly 28 includes a motor in mechanical communication with the brush tube 24 for reciprocating the brush tube 24, thereby reciprocating the reciprocating brush 18*b*. More specifically, the motor 36 is in mechanical communication with the brush tube 24 such that the motor linearly drives the brush tube 24. In the illustrated embodiment, the drive assembly 28 includes a solenoid mechanically connected to the brush tube 24. As depicted in FIG. 6, the plunger of a pull type solenoid is secured to the end portion of the brush tube 24. Activation of the solenoid forces the plunger into the inner shaft and likewise linearly drives the pulls the brush tube 24 inward to a first position, and upon deactivation the plunger returns to the outward position while linearly driving the brush tube 24 to a second position.

The debris removal assembly 30 includes a vacuum motor 38, duct connector 40, a debris receptacle 42, and a receptacle connector 44. The duct connector is provided for connecting the vacuum motor 38 to the duct 26. The vacuum motor 38 is configured such that the debris removal assembly 30 directs air to debris into the debris receptacle 42. For example, in the illustrated embodiment, the flow of air generated by the vacuum motor 38 directs debris on the bristles 16 and top surface of the platform 14 into the duct 26 of the brush tube 24, via the vents 20, and into the debris receptacle 42. In the illustrated embodiment, the vacuum motor 38 is connected to the debris receptacle 42 via tubing sufficiently sized for passage of debris into the debris receptacle 42. The debris receptacle 42 is an air permeable bag configured to retain any debris directed thereto. In one embodiment of the cleaning device 10, the debris receptacle 42 includes a filter for separating the debris from the air flow.

In addition to the foregoing description, the cleaning device 10 for shoe soles may be useful in other applications, such as contamination containment and security screening. In one embodiment used for contamination containment, the cleaning device 10 includes a high efficiency particulate air, or HEPA, filter for filtration of any harmful particles in the air flow. Using the cleaning device 10 in the decontamination procedure for leaving a radioactive area, which usually includes doffing clothing and stepping on a sticky pad, would further decreases the likelihood of contaminating the radiation monitor and the area beyond. In another embodiment, the cleaning device 10 is designed to be used in security screening procedures. Specifically, the cleaning device 10 is arranged such that the air flow carrying debris removed from the shoe soles is in communication with explosive sensors. Thus, the cleaning device 10 provides screening of explosive residue which may reside on the shoe soles.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A cleaning device for shoe soles comprising:
a platform having a plurality of channels spaced apart along a length of said platform;
a plurality of reciprocating brushes respectively disposed in said channels and reciprocally moveable with respect to said platform;
a plurality of ducts respectively positioned below each of said reciprocating brushes in said channels, each of said ducts including a plurality of vents for passage of debris from said reciprocating brushes to said ducts; and
a debris removal assembly connected to each of said reciprocating brushes to draw debris that has collected on the platform and reciprocating brushes into said ducts via said vents and thereafter removes the debris to said debris removal assembly;
wherein each reciprocating brush is supported by a hollow tube defining said duct therein.

2. The cleaning device of claim 1 wherein an upper section of said hollow tube protrudes from the channel, said upper section having said plurality of vents for passage of debris from said reciprocating brushes to said ducts.

3. A cleaning device for shoe soles comprising:
a platform having a plurality of channels spaced apart along a length of said platform;
a plurality of reciprocating brushes respectively disposed in said channels and reciprocally moveable with respect to said platform;
a plurality of stationary brushes respectively disposed between said reciprocating brushes to support shoe soles and inhibit movement of the shoe sole with respect to the platform as the reciprocating brushes are reciprocated;
a plurality of ducts respectively positioned below each of said reciprocating brushes in said channels, each of said ducts including a plurality of vents for passage of debris from said reciprocating brushes to said ducts;
a drive assembly drivingly connected to each of said plurality of reciprocating brushes for reciprocating said plurality of reciprocating brushes; and
a debris removal assembly connected to each of said reciprocating brushes to draw debris that has collected on the platform and reciprocating brushes into said ducts via said vents and thereafter removes the debris to said debris removal assembly;
wherein each reciprocating brush is supported by a hollow tube defining said duct therein.

4. The cleaning device of claim 3 wherein an upper section of said hollow tube protrudes from the channel, said upper section having said plurality of vents for passage of debris from said reciprocating brushes to said ducts.

5. A cleaning device for shoe soles comprising:
a platform having a plurality of channels defined along a length of said platform;

a plurality of reciprocating brushes respectively disposed in said channels and reciprocally moveable with respect to said platform;

a plurality of stationary brushes respectively disposed between said reciprocating brushes to support shoe soles and inhibit movement of the shoe sole with respect to the platform as the reciprocating brushes are reciprocated;

a plurality of ducts respectively positioned below each of said reciprocating brushes in said channels, each of said ducts including a plurality of vents for passage of debris from said reciprocating brushes to said ducts;

a drive assembly drivingly connected to each of said plurality of reciprocating brushes for reciprocating said plurality of reciprocating brushes;

a debris removal assembly connected to each of said reciprocating brushes to draw debris that has collected on the platform and reciprocating brushes into said ducts via said vents and thereafter remove the debris to said debris removal assembly; and a sanitizing assembly for sanitization of the shoe soles after debris is removed therefrom;

wherein said plurality of reciprocating brushes each comprise:

a hollow tube defining said duct therein, said hollow tube being configured to slideably reside in one of said plurality of channels such that said reciprocating brush can be reciprocated along the length of said base, an upper section of the hollow tube providing an exposed surface having said plurality of vents for passage of debris from said reciprocating brushes to said ducts; and a plurality of bristles disposed on said exposed surface, said plurality of bristles adapted to remove dirt and debris from the shoe sole when said reciprocating brush is reciprocated.

* * * * *